United States Patent [19]

Ferver

[11] 4,222,208

[45] Sep. 16, 1980

[54] MODULAR HOMES

[76] Inventor: George W. Ferver, 2490 Penn. Ave., Ext. R.D., Warren, Pa. 16365

[21] Appl. No.: 840,137

[22] Filed: Oct. 7, 1977

[51] Int. Cl.[2] ..... E02D 27/00

[52] U.S. Cl. ..... 52/169.5; 52/293; 52/299

[58] Field of Search ..... 52/292, 299, 169.1, 52/169.5, 293, 302, 303, 742, 262, 293; 405/252, 256, 255, 229, 284, 286; 256/24

[56] References Cited

U.S. PATENT DOCUMENTS

| | | | |
|---|---|---|---|
| 362,774 | 5/1887 | Nevison | 52/166 |
| 630,908 | 8/1899 | Mershon | 52/469 |
| 676,568 | 6/1901 | Mouchel | 405/229 |
| 1,038,257 | 9/1912 | Yourelle | 52/563 |
| 1,367,289 | 2/1921 | Waller | 52/469 |
| 1,372,206 | 3/1921 | Stadelman | 52/92 |
| 1,430,423 | 9/1922 | Weichold | 52/303 |
| 1,746,816 | 2/1930 | Boes | 52/303 |
| 1,757,077 | 5/1930 | Eiserloh | 52/262 |
| 1,892,605 | 12/1932 | Betzler | 52/293 |
| 2,329,585 | 9/1943 | Brewer | 52/303 |
| 2,362,162 | 11/1944 | Sheldon | 52/293 |
| 3,277,620 | 10/1966 | Martin | 52/292 |
| 3,452,498 | 7/1969 | Kinsey | 52/293 |
| 3,535,841 | 10/1970 | Lorenz | 52/262 |
| 3,596,419 | 8/1971 | Jalbert | 52/742 |
| 3,605,363 | 9/1971 | Bard | 52/293 |
| 3,662,507 | 5/1972 | Espeland | 52/293 |
| 3,685,241 | 8/1972 | Cooper | 52/270 |
| 3,740,909 | 6/1973 | Stinnes | 52/302 |
| 3,818,658 | 6/1974 | Slaven | 52/169.1 |
| 3,855,751 | 12/1974 | Struthers | 52/284 |

FOREIGN PATENT DOCUMENTS

| | | | |
|---|---|---|---|
| 399601 | 7/1909 | France | 405/286 |
| 808990 | 11/1936 | France | 405/284 |
| 1465081 | 11/1966 | France | 52/169.1 |
| 7240 | of 1901 | United Kingdom | 405/286 |

*Primary Examiner*—John E. Murtagh
*Attorney, Agent, or Firm*—Charles L. Lovercheck

[57] ABSTRACT

A series of preconstructed building components consisting of: hollow foundation members generally rectangular in cross-section having a closed bottom with outwardly extending flanges resting on gravel or the like, and a generally "U" shaped plate having slots for joists to rest atop the foundation members; or a foundation of a generally "U" shaped channel having slots for joists; hollow wall cells to rest on either foundation and extend upward therefrom; plates to rest on hollow wall cells for the support of a roof; roofing panels to rest on the plates so as to form a roof for the building; and various other components, as in way of example, lintels and closure panels such as are necessary to the construction of a building.

6 Claims, 20 Drawing Figures

Fig. 13.
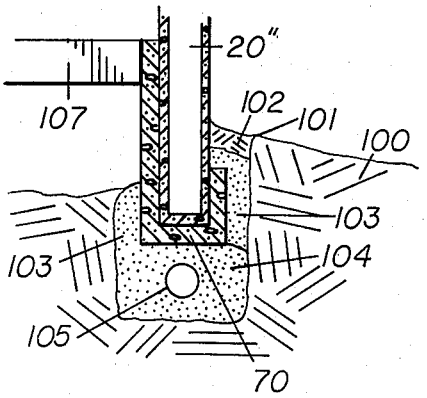
Fig. 14.
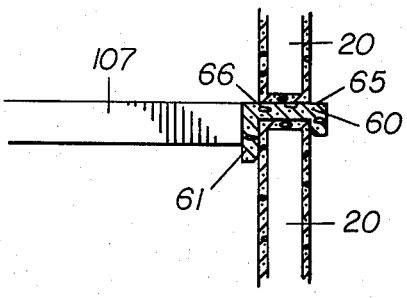
Fig. 15.
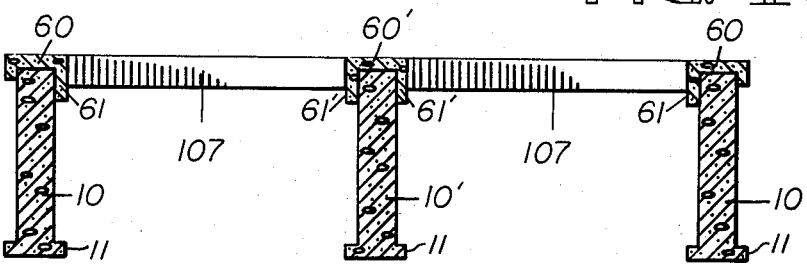
Fig. 16.
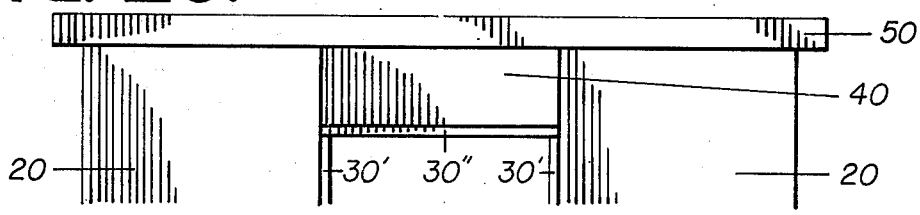
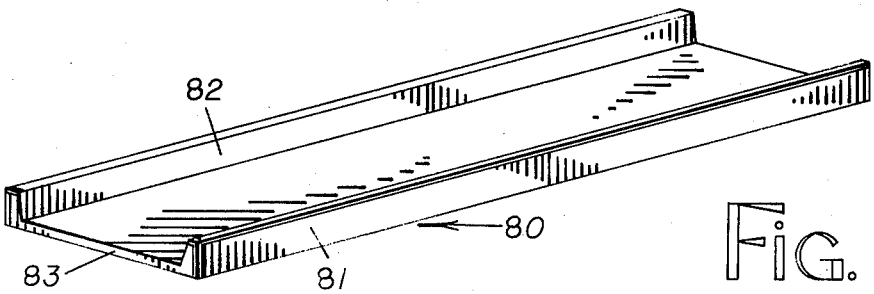
Fig. 17.

MODULAR HOMES

GENERAL DESCRIPTION OF THE INVENTION

The invention is a series of components which have been carefully engineered in various sizes and shapes which, when assembled and erected, can create a very desirable residence and dwelling place for members of the human race. The components are designed to be manufactured in a factory and taken to the erection location where the actual erection of the components involves only a fraction of the time and labor needed for ordinary, standard construction, and requires no consideration for weather conditions at the time of said erection. The components are capable of being placed in varying arrangements so as to provide buildings of different sizes and shapes, and thereby vary the architecture while still maintaining the unique advantages which each component offers.

Because of the fact that the outside-to-inside contact has been kept to a minimum, it is expected that the cost of heating and cooling these buildings can be reduced substantially over that of ordinary construction. It is expected that the buildings are virtually both fireproof and free of all ordinary maintenance, such as painting, roofing, etc. It can be made of reinforced concrete, which can be surface-sealed at the factory against the weather and will remain maintenance-free for an extended period of time. Its capacity to insulate is uniquely different and, therefore, provides the option of either above-ground or below-ground residences.

REFERENCE TO PRIOR ART

Applicant knows of no pertinent prior art other than the following U.S. patents: U.S. Pat. Nos. 1,679,684; 2,068,831; and 2,219,043.

OBJECTS OF THE INVENTION

It is an object of the invention to provide an improved construction system for single-family dwellings, townhouses, garden apartments, etc.

Another object of the invention is to provide a more fireproof, safe building.

Another object of the invention is to provide a construction which is so unique that the cost of heating and cooling the building can be greatly reduced.

Another object of the invention is to provide an exterior surface which is virtually maintenance-free and will withstand the rigors of the elements without breaking down or requiring the usual recurring periodic maintenance of standard construction.

Another object of the invention is to keep mortar joints to an absolute minimum so that deterioration and cracking are virtually eliminated.

Another object of the invention is to remove the stresses of backfill pressure on below-grade walls by the use of pressure panels designed to accept such stress.

Another object of the invention is to provide a below-grade building system which eliminates the small concrete cubicles ordinarily used in below-grade construction with their many cracks and mortar joints and, consequently, be eliminating the majority of these cracks and mortar joints, also greatly reduce the water seepage common to such standard construction.

Another object of the invention is to eliminate the need for a poured-in-place footer by casting it integrally on the bottom of the wall.

Another object of the invention is to provide an above-grade building system whose one-piece hollow wall castings have no contact between the inside and the outside surfaces, except at the floor and ceiling which can then be insulated.

Another object of the invention is to additionally spread the weight of the building over a larger area by pre-casting the foundation cap or plate and placing it on top of the wall.

Another object of the invention is to provide a building which needs no interior or exterior furring, paneling, bricking, or finishing to separate the interior and exterior walls from temperature differential for the elimination of condensation.

Another object of the invention is to provide a residence which can go for extended periods of time during emergencies without benefit of utilities and still remain comfortable.

Another object of the invention is to create a floor joist system which allows the joists to be dropped into slots instead of being nailed into a wooden floor framework.

Another object of the invention is to create walls so designed that the wall itself can serve as the reservoir for solar heat collectors.

Another object of the invention is to create a building system which can be built below ground and backfilled with earth without rot or deterioration to the structure, to thus gain the advantage of constant earth temperature.

Another object of the invention is to create a hollow, below-grade will so that any moisture attempting to penetrate that wall can be removed before it enters the basement, thereby eliminating the need for asphalt coating on below-grade walls.

Another object of the invention is to provide a building made of components which are economical to manufacture, readily transportable, and easily and inexpensively erectable.

Another object of the invention is to provide a building system of various components which can be manufactured in a manufacturing plant where temperature and humidity can be controlled and, consequently, provide high-volume, continuous production of quality residential components.

Another object of the invention is to provide a below-grade and above-grade building system which permits on-site construction to continue regardless of weather conditions by overcoming the problem of trying to work with wet concrete or mortar in rain or freezing weather, thus providing more economical construction of buildings and greatly reducing the seasonal fluctuation in production now common to the building industry.

Another object of the invention is to provide a residence which can be erected either in whole or in part by a contractor, with the home owner having the option of doing the interoir finishing of the home.

With the above and other objects in view, the present invention consists of the combination and arrangement of parts hereinafter more fully described, illustrated in the accompanying drawings, and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

FIG. 13 is a partial, cross-sectional view through the footer and drain tile.

FIG. 14 is a longitudinal, cross-sectional view of the exterior walls.

FIG. 15 is a longitudinal, cross-sectional view of another house according to the invention.

FIG. 16 is a partial, frontal wall detail showing usage of lintels.

FIG. 17 is an isometric view of a roofing member.

DETAILED DESCRIPTION OF THE DRAWINGS

Figure 1:
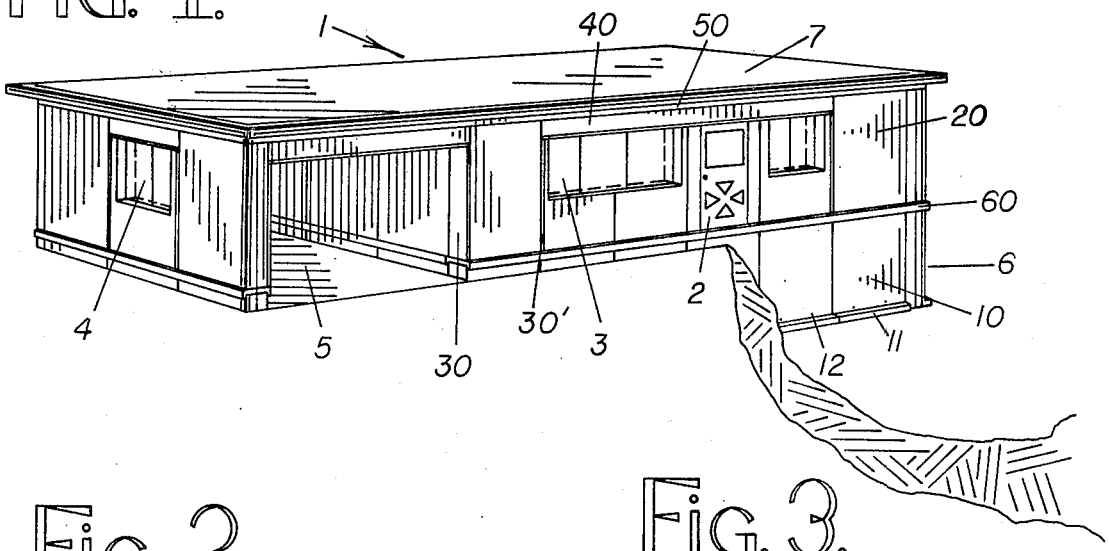
FIG. 1 is a perspective view of a flat-roofed house constructed in accordance with the invention.

Now, with more particular reference to the drawings, the embodiment of a house is shown in FIG. 1. The house has a front door 2, a picture window 3, a conventional window 4, a garage 5, a foundation 6, and a flat roof 7.

The house is constructed of modules, preferably of reinforced concrete. The foundation and below-grade walls 6 of the house 1 are made up of below-grade hollow concrete air cells used as foundation modules 10 which act as both the footers and support wall in the excavation for the residence. The house 1 need not necessarily have a conventional concrete footer resting on virgin soil because this below-grade module has extended feet or flanges 11 which are cast on the bottom integrally with the wall and which distribute the building's weight over the gravel that is spread on the soil in the excavation and which is non-compressible at the loading which will be encountered; and also because the extended plate 60 distributes the load of the above-grade wall air cells of the house over several foundation cells at one time. The below-grade foundation modules 10 come in varying heights to allow either a full basement, a crawl space, or an on-grade concrete slab, thereby gaining architectural versatility.

Figure 2:
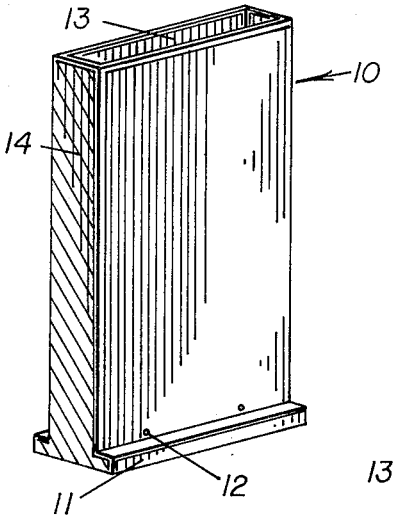
FIG. 2 is an isometric view of a basement module used in the construction of the house shown in FIG. 1.
Figure 3:
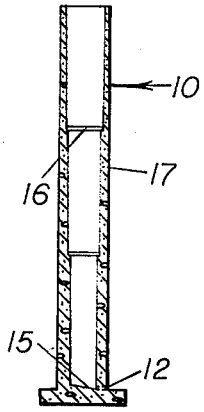
FIG. 3 is a longitudinal cross-sectional view of the basement module taken on Line 3—3 of FIG. 1.

The interior floor 15 of the hollow below-grade foundation modules 10 (FIG. 3) slopes toward its own outside wall. Weep holes 12 are cast into the outside wall so that any moisture seeping into the hollow 13 will be removed to the outside. Diversionary weep channels 14 are cast into the outside of the end walls of each foundation module 10 (FIG. 2) in a downward and outward fashion to divert any water attempting to get through between the wall castings.

One of the unique points of the foundation module 10 (FIG. 2 & 3) is its size, which may conveniently be roughly four feet by eight feet by one foot, having a hollow 13 which may be filled with insulating material and which is defined by sides and ends and an open top and a closed bottom with an outwardly, downwardly sloping interior floor 15 and drainage holes 12 and outwardly directed flanges 11. The foundation module 10 also has inner pressure panels 16 (FIG. 3) resting on shoulders 17 to resist and transfer the pressure bearing against the unit. The modules are erected by crane and require no consideration for weather conditions during their placement. The foundation module 10 could be placed on a conventional footer if it were to be used in conditions where the ground was swampy or unstable and would not support the weight of the building. It also might require an additional concrete footer if the house or residence has sufficient stories to increase the bearing-load-per-square-inch beyond the design capacity of the unit. This, however, is not contemplated as a requirement in residences of two stories or less.

Figure 8:
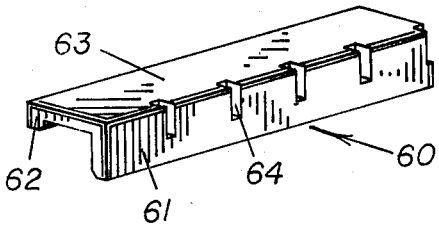
FIG. 8 is an isometric view of a plate with joist notches.

The plate 60 (FIG. 8) is erected on top of the below-grade foundation module 10 and has the unique property of serving as a second foundation by distributing the weight of the building over several of the below-grade concrete wall air cells 10 and automatically self-aligns them by receiving them into its channel-like casting made up of flanges 61 and 62 which are connected by a web 63. The slots 64 are for receiving floor joists. These slots may be of a conventional spacing such as, for example, 16 inches.

The plate 60 is designed to receive either two-inch by ten-inch floor joists in slots 64 which have been engineered and precast to receive them; or it will also receive steel trusses in slots which have been engineered and precast to receive them. Concrete decking of either precast or poured-in-place construction may also be placed directly on top of the plate 60. The flange 62 makes up an overhanging exterior edge 65 and further provides a foundation shelf upon which an exterior surface, such as brick or stone, can be safely erected.

Figure 4:
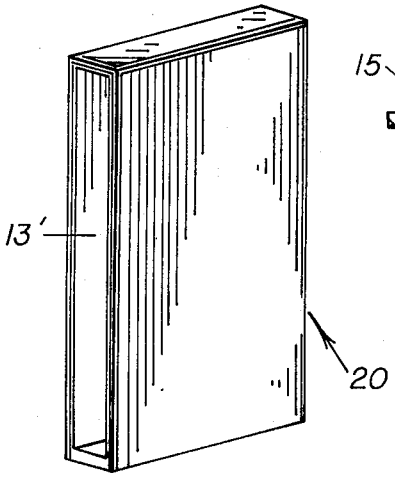
FIG. 4 is an isometric view of one of the wall cells.

The above grade air-cell wall foundation module 20 (FIG. 4) like 10, is designed to give the building a "thermos bottle" effect by eliminating as much as possible the contact between the inside air and the outside elements. The wall module 20 may also be made in an approximate size of four feet by eight feet by one foot, but modifications permit this to be made in varying heights and widths to meet the requirements of the architecture of the individual building. Being hollow, they provide approximately eight inches of tunnel-like cavity 13' which may be filled with an insulation such as polyurethane foam, wood fibre, or other types of suitable material which will assist in attaining the desired insulating effect; or it may be filled with large stones to serve as the reservoir for a solar collector.

The outside or exposed surface of wall module 20 may be cast in various appearances, such as by way of example but not limited to, lap siding, shingles, shakes, split rock, brick, barnboard, log cabin, etc., all of which are cast as a part of the surface through the use of already existing form liner inserts which create these appearances. Various exposed aggregates may also be used.

Figure 5:
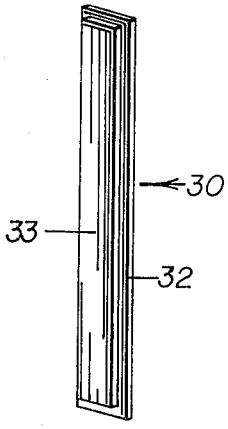
FIG. 5 is an isometric view of a closure member for one of the wall cells.

The closure 30 shown in FIG. 5 has a reduced size side 33 which is engineered to fit into the cavity 13' of the wall module 20, and an outwardly peripherally directed flange 32 designed to overlie the ends of the wall module 20. The closure 30 is used at any place that a window or door is to be set into a wall, or otherwise the wall needs to be terminated. The closure 30 will support and anchor a window or door in position and provides an adequate support for lintels 40 where needed, and is adapted to fit into the open downwardly-facing side of the lintel for greater anchoring stability and to provide a more finished appearance to the building. Like other components, the closure panel comes in varying heights to suit the particular architecture of the building. Closure panels are shown in FIG. 1 at the garage 30 and at the door and window section 30'.

Figure 6:
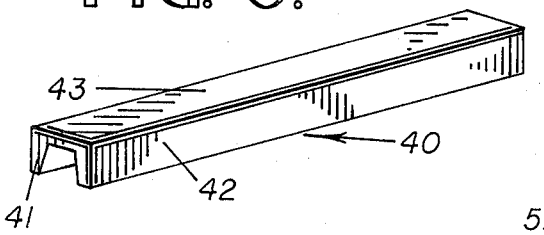
FIG. 6 is an isometric view of a header or lintel.

The header or lintel 40 (FIG. 6) may also be used as a threshold and, consequently, is utilized in various positions to suit the need for a load-bearing member in the architecture of the home. It consists of two flanges 41 and 42, and a web 43 connecting the flanges.

Figure 7:
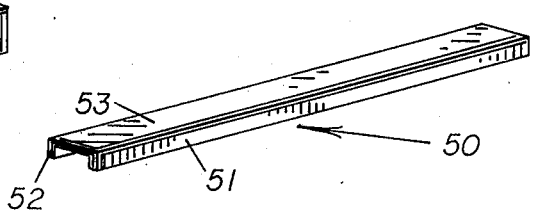
FIG. 7 is an isometric view of a plate.

Over the entire above-ground wall section, the plate 50 (FIG. 7) is used to provide alignment of the cells 20 and the lintels 40 and to act as the support for the roofing system. This plate performs the same function of alignment as the plate 60 in FIG. 8 except that it does not provide joist slots, and, therefore, it is contemplated that if the plate 50 is used between floors or atop the below-grade wall cells 10 that a system such as precast or poured-in-place flooring would be used. The plate 50 also serves as window sills or as a low-profile threshold and, consequently, is used in various positions to suit the architecture of the building.

Figure 9:
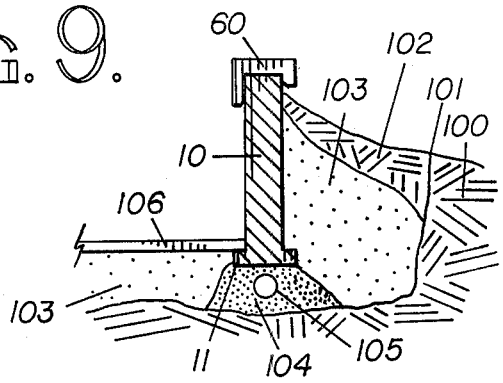
FIG. 9 is a longitudinal, cross-sectional view through the foundation member, backfill and footing.

FIG. 9 shows the recommended foundation detail of a residence utilizing the foundation module 10. The cross-section reveals an original grade 100 which has been excavated 101. Into the excavation is placed a drain pipe 105 and a sub-footer of non-compressible gravel 104, onto which is set the basement cell 10. For immediate backfill, a floor 106 such as precast concrete is set on the foot or flange 11 of the basement cell 10 to resist the backfill pressures at the base of the foundation unit 10, and alignment plate 60 (although 50 could be used) is installed. The floor joists are placed in position in their slots 64 and the backfill of gravel 103 and earth 102 is completed before the excavation becomes frozen or it rains.

It is not necessary to "tie" the wall modules 10 together because they are held in position at the bottom by the floor which holds the wall against any backfill pressure, and at the top by the aligning plate upon which the building rests. The crack between the wall cell modules does not require a water-tight seal because a unique feature of the cell is its end walls. These have diversionary weep channels 14 (FIG. 2) cast in an outward and downward slanting position. Any moisture which would attempt to pass through the wall is picked up by the channels and by gravity is diverted downward and outward to the gravel backfill which surrounds the building. The wall modules 10 may be made weather-tight for above-grade purposes by insulating or by sealing the units in a number of conventional ways. The below-grade portion need not be sealed because of the aforementioned diversionary weep channels, but sealing may be desirable under extreme conditions.

Figure 10:
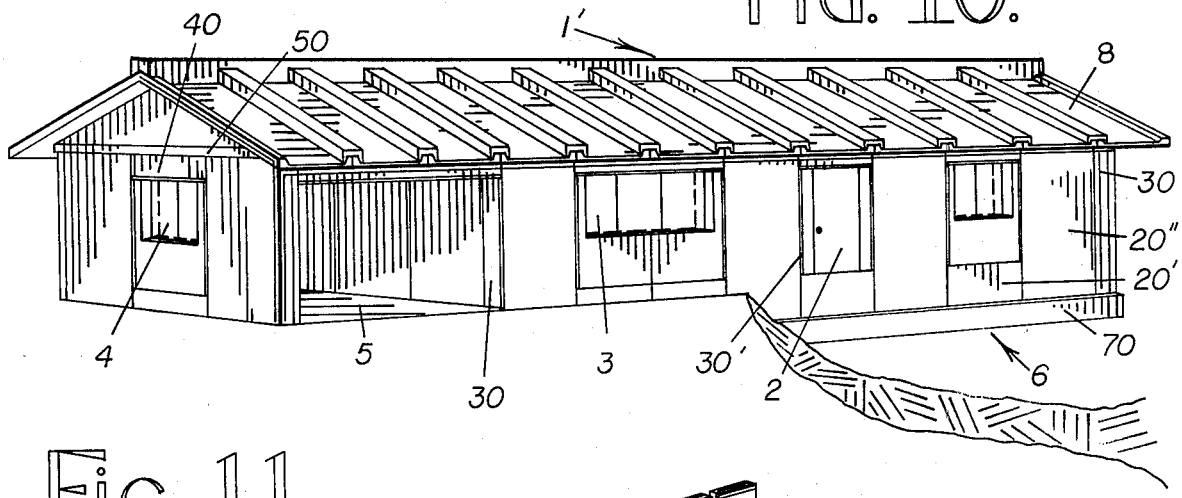
FIG. 10 is an isometric view of another house according to the invention.

The house 1' in FIG. 10 shows two embodiments which may be interchanged with the corresponding parts in FIG. 1 without affecting each other. They are peaked roof 8 and the crawl space or "on-grade" type foundation 6'.

Figure 11:
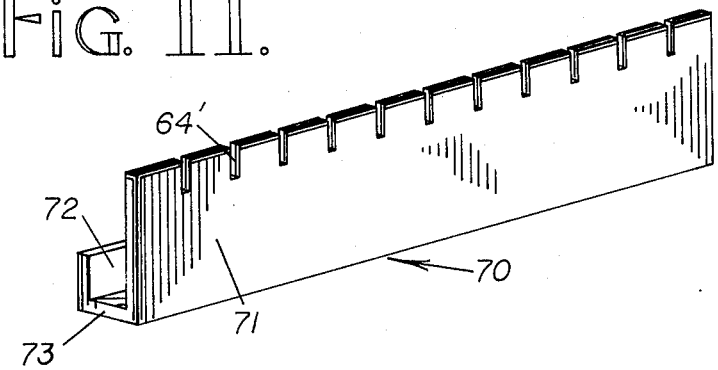
FIG. 11 is an isometric view of a footer member.

The foundation member 70 in FIG. 11 is a generally "U" shaped member designed and engineered to receive the wall cells 20' and 20'' directly into its channel. It consists of two flanges 71 and 72 connected by a web 73. One channel 71 has joist slots 64' cast into it to receive either the standard wooden joists or steel joists. The web 73 has drainage holes 12' in it to permit the escape of water.

Figure 12:
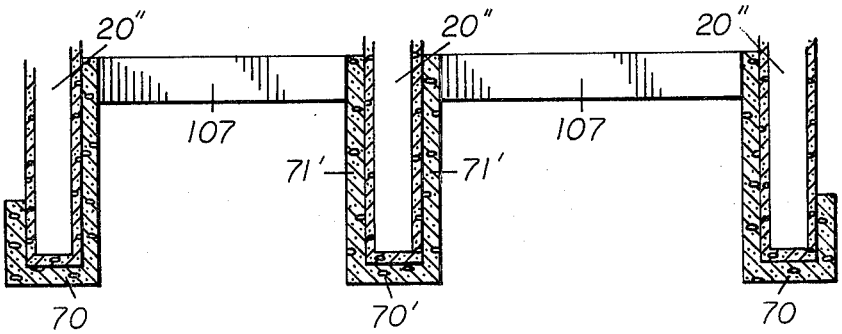
FIG. 12 is a longitudinal, cross-sectional view through the center of the house.

FIG. 12 shows a wall detail using the foundation modules 70 at each end and a module 70' at the center of the house for a load-bearing wall. The member 70' has two legs 71' of equal length to support the joists 107.

Footer detail as shown in FIG. 13 shows the original grade 100 which has been excavated 101 and partially filled with gravel 104 and a drain 105. Onto this is placed the foundation unit 70 and the wall cell 20'' which has been modified to provide extra length since it starts below the floor level shown by the joist 107. Once the wall cell 20'' has been set, the excavation may be filled with more gravel 103 and earth 102.

FIG. 14 shows wall and floor detail. This system is used for placing walls 20, 20' and 20'' on basement cells 10 (or, as in multiple-story construction, on other wall cells) if standard flooring with joists is being used. It shows the first wall panel 20 with plate 60 atop and another wall panel 20 above the plate. The plate 60 has received joist 107 and has lip 66 for setting precast or poured-in-place flooring. The lip 65 is for the construction of brick or stone or other facing material is so desired.

Load-bearing walls can also be obtained as in FIG. 15 by using the below-grade cell 10 in both the exterior wall locations and also the center wall location. The plate 60' will have two legs 61' cast full height with joist slots 64 in both. In this manner, joists 107 can be set on both sides of the center load-bearing wall and construction continues as before.

In the exterior walls FIG. 16 are wall cells 20 with an opening between them for a window or door. The support of the roof is attained by closing the open portions of the wall with closure panels 30' cast shorter than standard and spanning the open area with another closure panel 30'' onto the small side of which is set a lintel 40 open side down. The length so spanned can be more than one cell in width to obtain architectural versatility. The entire system is then aligned by setting a plate 50 over the wall.

Figure 19:
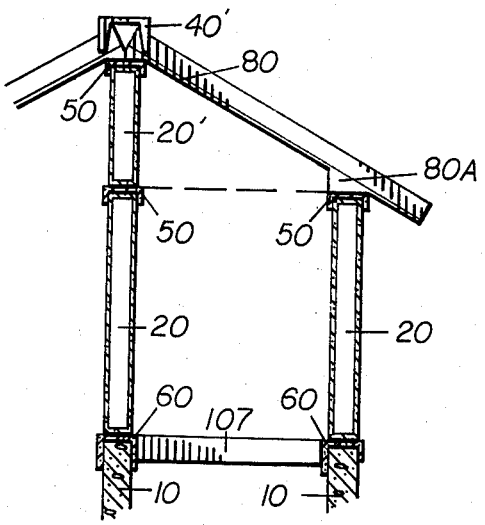
FIG. 19 is a partial longitudinal cross-sectional view of a roof and house structure.
Figure 18:
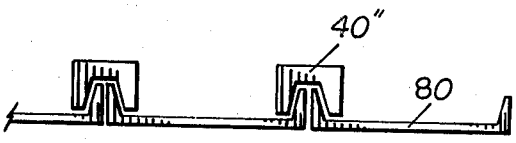
FIG. 18 is a partial cross-sectional view of individual sections of roof.
Figure 20:
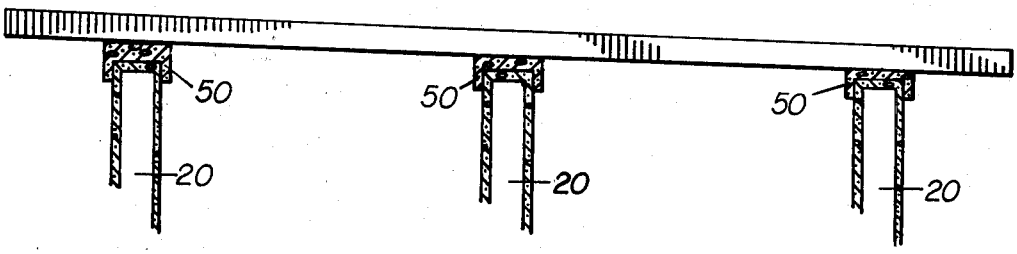
FIG. 20 is a partial longitudinal cross-sectional view of another roof according to the invention.

FIG. 17, the roofing member 80 is cast in varying lengths and widths to permit use in a broad range of structural sizes. The roofing member consists of two flanges 81 and 82 connected by the web 83. Flat roofs (FIG. 1) are merely laid in place as shown in FIG. 20. In sloped roofs 8 (FIG. 10), the members 80 are cast with supports 80A (FIG. 19) to allow them to sit solidly atop the plate 50 which aligns the wall sections 20 and 20'. Cross-section of FIG. 18 shows the roof sections 80 and 40'' alternating in position so as to obtain an appealing effect. The panels 80 and 40'' could also be cast the same width so as to cover a larger area more quickly and with fewer units.

Other uses to which the components can be put are realized when one considers that the lintel 40, when modified, becomes a ridge cap 40' (FIG. 19) for the peaked roof or, when ganged together side-by-side, makes a superior garage floor due to its capacity to withstand extreme loads. Other components can be used as patios, rain troughs, walks, steps, and so on as to be left to the imagination as the components' versatility and usefulness indicate.

The foregoing specification sets forth the invention in its preferred, practical forms, but the structures shown are capable of modification within a range of equivalents without departing from the invention is to be understood is broadly novel as is commensurate with the appended claims.

The embodiments of the invention in which an exclusive property or privilege is claimed are defined as follows:

1. A building comprising foundation modules (10), each said foundation module having two spaced sides and two spaced ends and a solid bottom and an open top defining an enclosure, said bottom extending outwardly at each side from said side walls, forming two solid outwardly directed flanges having a top surface integrally connected to said bottom forming a continuation of said bottom, said flanges, sides, ends and bottoms being integrally cast from concrete, said bottom and flanges having substantially a flat lower surface adapted to rest on a pre-leveled gravel base, said enclosure is adapted to contain a low heat conductive insulation material, said top surface of said bottom being disposed in a plane substantially parallel with the top surface of said flanges and means supporting wall members of said building on said top surface of said foundation forming said building.

2. The closure recited in claim 1 wherein vertically spaced pressure panels are formed in said hollow between said side walls, said pressure panels being attached to said side walls providing resistance to the force of lateral loads on said module.

3. The building recited in claim 1 wherein a plurality of said foundation modules are aligned with each other on said gravel base, the said open tops of said modules being aligned with each other, said means supporting said wall members of said building comprising, a plate (60) U-shaped in cross section resting on said open tops, said plate having spaced flanges extending downwardly along the side of said modules holding said modules in alignment with each other, said wall member resting on said plate.

4. The house recited in claim 3 wherein said plates have spaced notches formed in the upper portion thereof, said notches being adapted to receive the ends of joists.

5. The house recited in claim 4 wherein a wall module is provided resting on said plate, said wall module having spaced sides, a closed top and closed bottom and open ends said closed bottom resting on said plate.

6. The house recited in claim 5 wherein a second said U-shaped plate is supported on said wall modules, said second U-shaped plate having flanges extending along the edges of said wall modules holding said wall modules in alignment with each other.

* * * * *